US007552576B2

(12) United States Patent
Strauss

(10) Patent No.: US 7,552,576 B2
(45) Date of Patent: Jun. 30, 2009

(54) SPUR WITH REMOVABLE END PIECE

(75) Inventor: Isidore Strauss, Bridgewater, NJ (US)

(73) Assignee: Intec Corporation, Cliffwood, NJ (US)

( * ) Notice: Subject to any disclaimer, the term of this patent is extended or adjusted under 35 U.S.C. 154(b) by 0 days.

(21) Appl. No.: 11/781,069

(22) Filed: Jul. 20, 2007

(65) Prior Publication Data

US 2008/0016828 A1 Jan. 24, 2008

Related U.S. Application Data

(60) Provisional application No. 60/832,419, filed on Jul. 21, 2006.

(51) Int. Cl.
*A43C 17/00* (2006.01)

(52) U.S. Cl. ..... 54/83.1

(58) Field of Classification Search ..... 54/83.1, 54/83.2, 49.5; 36/74

See application file for complete search history.

(56) References Cited

U.S. PATENT DOCUMENTS

| | | | | | |
|---|---|---|---|---|---|
| 12,338 | A * | 1/1855 | Ewbank | 54/83.2 |
| 37,880 | A * | 3/1863 | Townsend | 54/83.2 |
| 186,985 | A * | 2/1877 | Buermann | 54/83.2 |
| 304,460 | A * | 9/1884 | Schmidt | 54/83.2 |
| 694,421 | A * | 3/1902 | Ridings | 54/83.2 |
| 810,049 | A * | 1/1906 | Gilbough | 54/83.2 |
| 1,057,620 | A * | 4/1913 | Copley | 54/83.2 |
| 1,065,019 | A * | 6/1913 | Barr | 54/83.2 |
| 2,454,228 | A * | 11/1948 | Smith | 54/83.1 |
| 2,468,918 | A * | 5/1949 | Bowers | 54/83.1 |
| 2,907,161 | A * | 10/1959 | Chandler et al. | 54/83.1 |
| 4,513,561 | A * | 4/1985 | Welton et al. | 54/83.1 |
| 5,394,677 | A * | 3/1995 | Van Scoyk | 54/83.1 |
| 5,913,800 | A * | 6/1999 | Williams | 54/83.1 |
| 6,339,915 | B1 * | 1/2002 | Bradbury | 54/83.1 |
| 2003/0033789 | A1 * | 2/2003 | Harrison et al. | 54/83.1 |

FOREIGN PATENT DOCUMENTS

FR 2633494 A1 * 1/1990

OTHER PUBLICATIONS

"Spur," Wikipedia, en.wikipedia.org/wiki/Spur, Jul. 17, 2007, 3 pps.

* cited by examiner

*Primary Examiner*—Son T. Nguyen
(74) *Attorney, Agent, or Firm*—King & Schickli, PLLC

(57) ABSTRACT

A spur for equitation includes a substantially arcuate body and an end piece for contacting a portion of a body of an animal being ridden, the end piece being removably attached to the spur. The end piece may include a first and a second portion and a cooperating connector for removably connecting the two portions with a portion of the spur captured therebetween, whereby the cooperating connector defines an axis about which the end piece is rotatable. The end piece may be removably attached to a shank extending from the body. The shank may include a flattened portion defining a plane which is substantially coplanar with a plane defined by the spur body. The rotatable end piece first and second portions attach to the shank whereby the axis defined by the cooperating connector is substantially perpendicular to the plane defined by the spur body and shank flattened portion.

16 Claims, 3 Drawing Sheets

SPUR WITH REMOVABLE END PIECE

This application claims the benefit of priority in U.S. Provisional Patent Application Ser. No. 60/832,419 filed on Jul. 21, 2006, the disclosure of which is incorporated herein in its entirety by reference.

TECHNICAL FIELD

The present invention relates to a spur for use in equitation. In particular, the invention relates to a spur having a removable end. A variety of end shapes may be provided, in accordance with the temperament of the horse being ridden and the amount of persuasion required to cause the horse to perform a desired maneuver or maneuvers. The removable end may be provided also in a multitude of colors, allowing the user to customize the spur as desired.

BACKGROUND OF THE INVENTION

It is known to provide spurs for use in equitation, such spurs typically including a body which may be secured to a riding boot or shoe, and a shank which may be placed in contact with the body of a horse or other animal being ridden. Spurs supplement the traditional aids used by a rider (leg, seat, reins, and voice) to control the animal's movement.

A wide variety of shapes for spur shank ends are known in the art. A spur configuration may vary from a shank having a simple blunt or rounded end such as is common for English-style riding spurs, to a shank having a cog or star-shaped rowel as is common in traditional Western-style spurs. Particularly sensitive or nervous animals, or alternatively well-trained and highly responsive animals, may require only a mild spur having a shank with a very short, blunt or rounded end. On the other hand, less sensitive or more stubborn and difficult to control animals may require a spur with a shank having a longer or harsher end for proper control of their movement. Additionally, certain riding disciplines such as dressage may only allow particular shank end designs in a competition situation, whereas the rider may wish to use a differently-shaped spur shank during training sessions.

The conventional spur includes a fixed shank with a fixed, non-replaceable end. Accordingly, in order to be able to change the shape of the shank end to match the temperament of the horse to be ridden or the requirements of a particular competition or training session, a rider must typically purchase a variety of spurs, adding to the cost of the sport. There is accordingly a need in the art for a spur with an inexpensive, conveniently removable and interchangeable end allowing the same spur to be used in riding a variety of horses with a variety of temperaments, or in a variety of training and/or competition situations.

SUMMARY OF THE INVENTION

In accordance with the need identified in the art, the present invention provides a spur, comprising a substantially arcuate body and a removable end piece for contacting a portion of a body of an animal being ridden, as a supplement to other traditional riding aids such as seat, legs, and voice. The end piece may be attached to the spur body whereby it is rotatable, to provide a milder spur. The removable end piece is typically attached to a shank extending from the spur body.

The end piece comprises a first and a second portion, and a cooperating connector for removably attaching the first and second portions to one another with a portion of the spur captured therebetween. The cooperating connector may define an axis about which the end piece is rotatable. In one embodiment, the cooperating connector may be a "Chicago screw" or screw post, comprising an internally threaded sleeve carried on the end piece first portion and a cooperating threaded post carried on the end piece second portion. A variety of end piece designs may be provided, allowing the user to configure the spur into a number of known spur designs, including without limitation as a roller spur, a round end spur, a knob end spur, a Prince of Wales spur, a disc spur, a rowel spur, a swan-neck spur, a Waterford spur, or the like.

Still further, the present invention provides a kit, comprising a substantially arcuate spur body having an integral shank extending therefrom and at least two end pieces for contacting a portion of an animal being ridden, the end pieces being removably attachable to the shank to form a spur. The end pieces may be fabricated to allow the user to alter the spur with respect to at least one of color and configuration. The kit may further include at least one strap for securing the spur to a rider's boot or shoe.

It should be appreciated that the embodiments shown and described herein are an illustration of one of the modes best suited to carry out the invention. It will be realized that the invention is capable of other different embodiments and its several details are capable of modification in various, obvious aspects all without departing from the invention. Accordingly, the drawings and descriptions will be regarded as illustrative in nature, and not as restrictive.

BRIEF DESCRIPTION OF THE DRAWING

The accompanying drawings incorporated in and forming apart of the specification, illustrates several aspects of the present invention, and together with the description serves to explain the principles of the invention. In the drawings.

Figure 1:
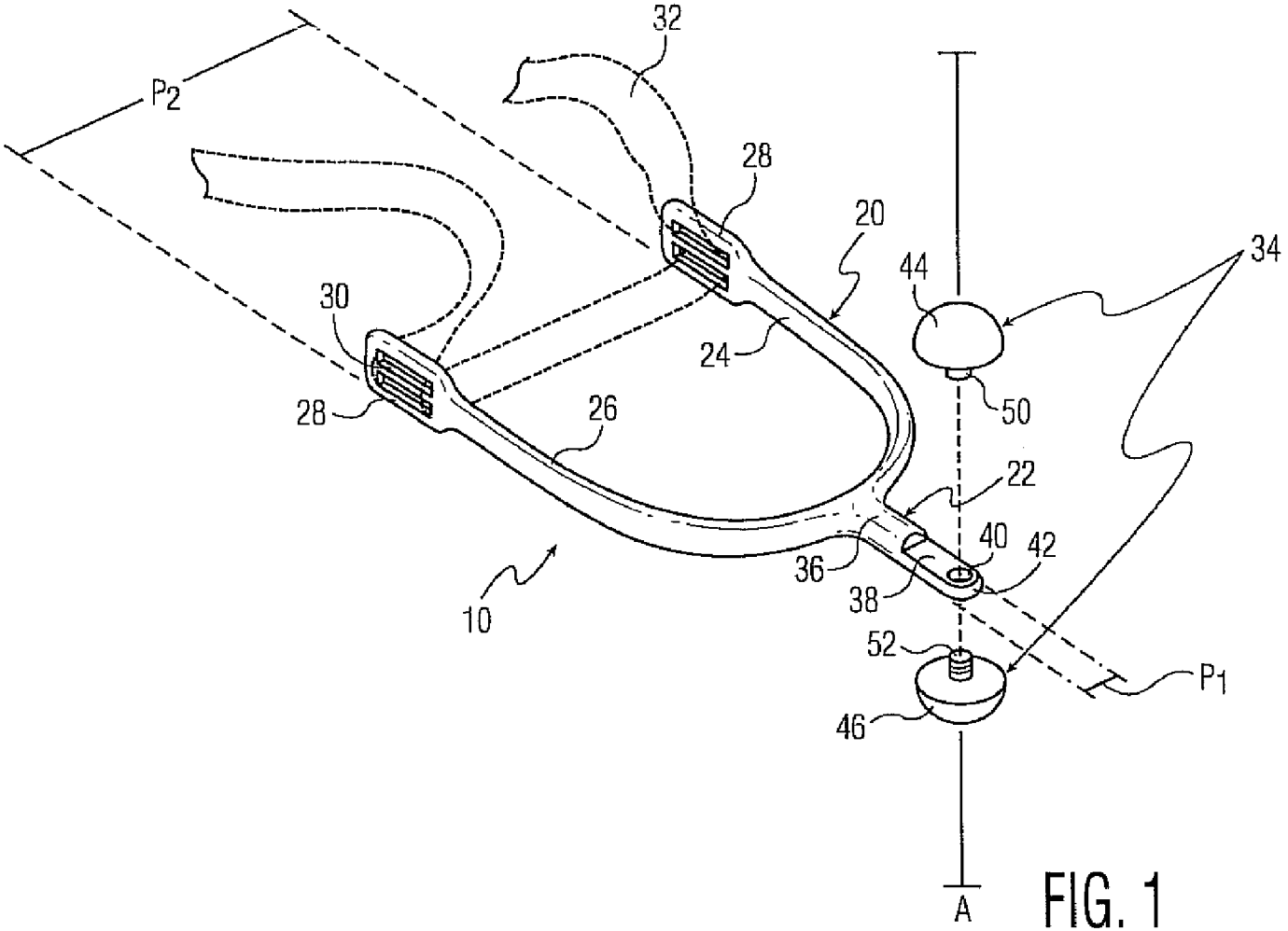
FIG. 1 shows one embodiment of the spur of the present invention, with the removable end piece shown in exploded view.

Reference will now be made in detail to the best mode contemplated for carrying out the invention, examples of which are illustrated in the accompanying drawings. The examples are presented in support of and to further illustrate the invention as described herein. However, the invention is not to be considered as limited thereto.

DETAILED DESCRIPTION OF THE INVENTION

In accordance with the need identified in the foregoing discussion, the present invention provides a spur 10, comprising a substantially arcuate body 20, and a shank 22. Body 20 includes arms 24, 26 terminating in ends 28. Each end 28 may include slots 30, through which a strap 32 (shown in broken lines for convenience) may be threaded for securing the spur 10 to a rider's boot or shoe (not shown). In one embodiment, shank 22 comprises a post 36 terminating in a flattened portion 38. Flattened portion 38 includes an aperture 40 passing therethrough. Flattened portion 38 may further include a rounded top 42. A removable end piece 34 is provided, which may be removably attached to shank 22. In the depicted embodiment, removable end piece 34 comprises a bifurcate construction which is secured to spur 10 by passing a portion thereof through aperture 40 of shank flattened portion 38. An edge of end piece 34 may extend a distance beyond an edge of the shank 22, providing a surface for contacting a portion of an animal being ridden.

Figure 2:
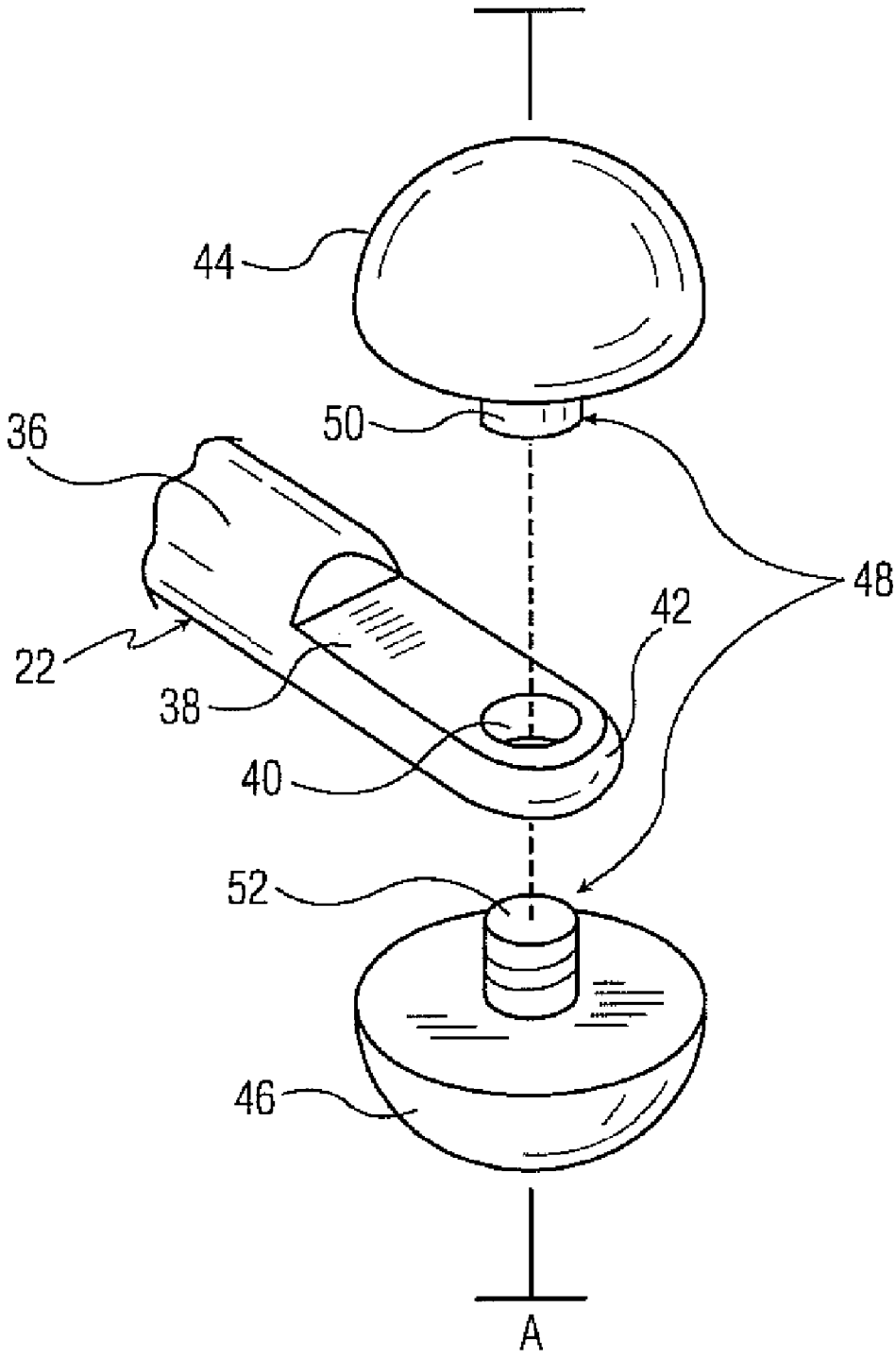
FIG. 2 shows a close up view of the end piece.

With reference to FIGS. 1 and 2, end piece 34 includes first and second portions 44, 46. A cooperating connector 48 is used to attach first and second portions 44, 46, in the depicted embodiment (see FIG. 2) being a "Chicago screw" or screw post having an internally threaded post 50 extending from first portion 44 and a cooperating threaded screw 52 extending from second portion 46. Shank 22 includes an aperture 40 for slidably receiving post 50 therethrough. Accordingly, it will be clearly apparent that the user need only pass post 50 through aperture 40, and secure screw 52 thereto to fasten the end piece 34 to the spur shank 22. It will be appreciated that, when end piece 34 is assembled and secured to shank 22 as described, cooperating connector 48 defines an axis A about which end piece 34 may rotate.

Of course, alternative cooperating connectors 48 (not shown) are contemplated for use with the present invention, such as for example cooperating connector 48 which attaches first and second portions 44, 46 one to another by means of an interference fit, a push fit, a snap fit, or the like, with the proviso that the cooperating connectors 48 should be releasable. Still further, cooperating connector 48 may be sized whereby, when end piece 34 is attached to spur body 20, cooperating connector 48 forms an interference or friction fit in aperture 40, preventing rotation when rotation of end piece 34 is not desired.

As shown in FIG. 1, shank 22 flattened portion 38 defines a plane $P_1$ which is substantially coplanar with a plane $P_2$ defined by the spur body 20, such that the axis A defined by the cooperating connector 48 is substantially perpendicular to planes $P_1$ and $P_2$ when the spur 10 is assembled. In the depicted embodiment, the rotatable end piece 34, when assembled and touched to a side of a horse or other animal (not shown) being ridden, will rotate as it is passed along the horse's side in a direction substantially perpendicular to the ground, reducing the risk of spur rubs and providing a milder spur 10. Of course, it will be appreciated that other embodiments (not shown) are possible, such as flattened portion 38 defining a plane $P_1$ and a spur body defining a plane $P_2$ wherein plane $P_1$ and plane $P_2$ are offset and parallel one to the other, for accommodating a shank 22 which is offset from arcuate body 20, such as in the case of a swan-neck spur. Still further, flattened portion 38 may be oriented such that in the assembled spur 10, the cooperating connector 48 defines an axis A which is substantially coplanar to planes $P_1$ and $P_2$ when the spur 10 is assembled (embodiment not shown).

The first and second portions 44, 46 of interchangeable end piece 34 may be fabricated of any suitable substance, such as for example rubber having a suitable hardness, a plastic or other polyiner material, or metal. It will be appreciated also that any desired color or color combination may be used, in accordance with the user's tastes or desires and/or the dictates of any particular governing body in the case of use of the spur in an equitation competition.

Figure 3A:
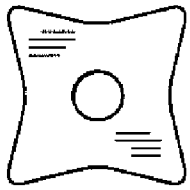
FIGS. 3A-3E depict alternative embodiments of the end piece.
Figure 3B:
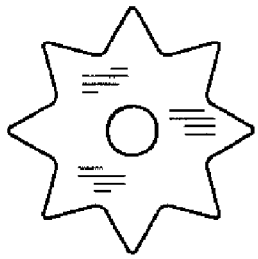
Figure 3C:
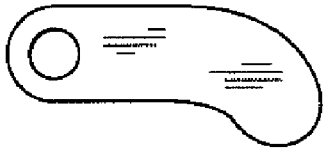
Figure 3D:
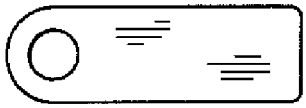
Figure 3E:
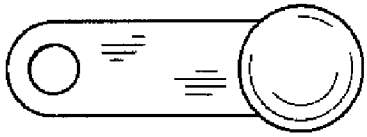

Still further, any of a number of shapes for the end piece 34 first and second portions 44, 46 are contemplated. In the embodiment of the invention depicted in FIGS. 1 and 2, end piece 34 defines a rotatable spherical shape, which when secured to spur body 20 provides a roller spur. End pieces 34 may be provided allowing the user to reconfigure the spur 10 into a number of spur types. End pieces 34 defining a number of alternative shapes may be provided, such as cogs or rowels (see FIGS. 3A and 3B). Indeed, a wide variety of end pieces 34 may be provided, which when attached to a spur body 20 provide a variety of well-known spur types, including without limitation a round end or knob end spur, a Prince of Wales spur (FIG. 3D), a disc spur, a swan-neck spur (FIG. 3C), a Waterford spur (FIG. 3E), and the like. Of course, any desired shape of end piece 34 may be provided in accordance with the desired function and harshness of spur, even if the resulting spur 10 is not a traditional spur type known in the art, such as is set forth herein.

Accordingly, there is provided a novel spur 10 allowing the user to alter the spur configuration as desired. For example, the user may configure spur 10 as a training spur having a rowel or other harsher end piece 34 (FIGS. 3A and 3B) to a spur 10 having a milder end piece 34 suitable for dressage competition (FIG. 1, FIG. 2, FIGS. 3C, 3D, and 3E). The skilled artisan will appreciate that for spur 10 designs wherein rotation of the end piece 34 is undesirable, such as a Prince of Wales spur (FIG. 3D), a swan-neck spur (FIG. 3C), and the like, a cooperating connector 48 providing an interference or friction fit with aperture 40 of shank 22 may be provided, wherein a suitably snug connection is provided whereby rotation is prevented. The present invention also allows the user to alter the appearance of the spur as desired for decorative purposes, that is, to provide end pieces 34 having different colors, textures, finishes, and the like.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the foregoing description when interpreted in accordance with the breadth to which it is fairly, legally and equitably entitled.

What is claimed is:

1. A spur for equitation, comprising:

a substantially arcuate body; and a bifurcated end piece for contacting a portion of an animal being ridden, the end piece being removably attachable to the spur;

wherein the end piece consists of a first portion, a second portion, and a cooperating connector for removably attaching said first portion to said second portion with a portion of the spur captured therebetween, further wherein the cooperating connector is integral with the first portion and second portion and defines an axis about which the assembled end piece is rotatable.

2. The spur of claim 1, wherein the cooperating connector comprises an internally threaded sleeve carried on the end piece first portion and a cooperating threaded post carried on the end piece second portion.

3. The spur of claim 1, wherein the end piece is removably attached to a shank extending from the body.

4. The spur of claim 3, wherein the shank comprises a substantially flattened portion having an aperture defined therethrough for receiving the cooperating connector.

5. The spur of claim 4, wherein the shank flattened portion defines a plane which is substantially coplanar with a plane defined by the spur body, and the rotatable end piece first and second portions attach to the shank whereby the axis defined by the cooperating connector is substantially perpendicular to the plane defined by the shank flattened portion.

6. The spur of claim 4, wherein an edge of the end piece extends a distance beyond an edge of the shank flattened portion.

7. The spur of claim 6, wherein the spur body, shank, and end piece first and second portions when assembled define one of a roller spur, a round end spur, a knob end spur, a Prince of Wales spur, a disc spur, a rowel spur, a swan-neck spur, and a Waterford spur.

8. A spur for equitation, comprising:

a substantially arcuate body;

a shank integral to and extending from the body; and a bifurcated rotatable end piece for contacting a portion of a body of an animal being ridden, the rotatable end piece being removably attached to the shank;

wherein the rotatable end piece consists of a first portion and a second portion, and a cooperating connector removably attaches said first portion to said second portion with a portion of the shank captured therebetween, whereby the cooperating connector is integral with the first portion and second portion and defines an axis about which the assembled end piece is rotatable.

9. The spur of claim 8, wherein the shank comprises a substantially flattened portion having an aperture defined therethrough for receiving the cooperating connector.

10. The spur of claim 9, wherein the shank flattened portion defines a plane which is substantially coplanar with a plane defined by the spur body, and the rotatable end piece first and second portions attach to the shank whereby the axis defined by the cooperating connector is substantially perpendicular to the plane defined by the spur body and shank flattened portion.

11. The spur of claim 10, wherein an edge of the rotatable end piece extends a distance beyond an edge of the shank flattened portion.

12. The spur of claim 11, wherein the spur body, shank, and rotatable end piece first and second portions when assembled define one of a roller spur, a round end spur, a knob end spur, a disc spur, a rowel spur, a swan-neck spur, and a Waterford spur.

13. A kit, comprising:

at least two substantially arcuate spur bodies having an integral shank extending therefrom; and at least two bifurcated end pieces for contacting a portion of an animal being ridden, the end pieces being removably attachable to the shank;

wherein the end pieces consist of a first portion and a second portion and a cooperating connector for removably attaching said first portion to said second portion with a portion of the shank captured therebetween, whereby the cooperating connector is integral with the first portion and second portion and defines an axis about which the assembled end pieces are rotatable.

14. The kit of claim 13, wherein the at least two end pieces allow alteration of a spur comprising the spur body and an end piece with respect to at least one of color and configuration.

15. The kit of claim 14, wherein the at least two end pieces are fabricated to allow formation of one or more of a roller spur, a round end spur, a knob end spur, a Prince of Wales spur, a disc spur, a rowel spur, a swan-neck spur, and a Waterford spur.

16. The kit of claim 14, further including at least one strap for attaching the spur body to a user's boot or shoe.

* * * * *